US006397444B1

(12) United States Patent
Foster et al.

(10) Patent No.: US 6,397,444 B1
(45) Date of Patent: Jun. 4, 2002

(54) APPARATUS AND METHOD FOR TEXTURING YARN

(75) Inventors: Peter William Foster, Alderley Edge; Duncan Cameron Ferrier, Tiverton; Ujithe Sujeewa Wickramasinghe Gunasekera, Manchester, all of (GB)

(73) Assignee: University of Manchester Institute of Science & Technology, Manchester (GB)

( * ) Notice: Subject to any disclaimer, the term of this patent is extended or adjusted under 35 U.S.C. 154(b) by 0 days.

(21) Appl. No.: 09/513,802

(22) Filed: Feb. 25, 2000

Related U.S. Application Data

(63) Continuation-in-part of application No. 09/356,687, filed on Jul. 20, 1999, now Pat. No. 6,139,588, which is a continuation of application No. 08/737,653, filed on Nov. 22, 1996, now Pat. No. 5,931,972.

(30) Foreign Application Priority Data

| | | |
|---|---|---|
| May 24, 1994 | (GB) | 9410379 |
| Jul. 8, 1999 | (GB) | 9915922 |
| Jul. 8, 1999 | (GB) | 9915923 |
| Jul. 8, 1999 | (GB) | 9915924 |

(51) Int. Cl.[7] ..... D02G 1/16; D02J 1/08
(52) U.S. Cl. ..... 28/271; 28/274; 28/220
(58) Field of Search ..... 28/271, 272, 273, 28/274, 275, 276, 258, 248, 220; 57/264, 289, 333, 350, 908; 8/151.2, 149.1; 68/5 E, 5 D

(56) References Cited

U.S. PATENT DOCUMENTS

| | | | | |
|---|---|---|---|---|
| 3,061,941 A | | 11/1962 | Goy et al. | |
| 3,093,878 A | * | 6/1963 | Fieldman | 28/276 |
| 3,175,375 A | | 3/1965 | Yazawa et al. | |
| 3,213,470 A | | 10/1965 | Yazawa et al. | |
| 3,241,343 A | | 3/1966 | Yazawa | |
| 3,320,776 A | | 5/1967 | Gorodissky et al. | |
| 3,349,578 A | | 10/1967 | Greer et al. | |
| 3,474,510 A | * | 10/1969 | Torsellini | 28/1 |
| 3,563,064 A | | 2/1971 | Yazawa | |
| 3,773,483 A | * | 11/1973 | Schmidt | 28/271 |
| 3,783,596 A | * | 1/1974 | Waldkirch | 57/157 F |
| 3,783,649 A | | 1/1974 | Yamamoto et al. | |
| 3,842,468 A | * | 10/1974 | Harrison | 28/1.4 |
| 3,916,493 A | * | 11/1975 | Ethridge | 28/1.4 |
| 3,927,540 A | | 12/1975 | Tanaka et al. | |
| 3,965,511 A | | 6/1976 | Fleissner | |
| 4,010,529 A | * | 3/1977 | Honegger | 28/1.2 |
| 4,138,840 A | * | 2/1979 | Greenway et al. | 28/276 |
| 4,192,047 A | * | 3/1980 | Foster et al. | 28/220 |
| 4,226,092 A | | 10/1980 | Lüthi | |
| 4,286,394 A | | 9/1981 | Gort | |
| 4,412,371 A | * | 11/1983 | Hagen et al. | 28/272 |
| 4,497,099 A | * | 2/1985 | Scott | 28/220 |
| 4,570,312 A | * | 2/1986 | Whitener, Jr. | 28/271 |
| 4,586,934 A | | 5/1986 | Blalock et al. | |
| 5,054,174 A | * | 10/1991 | Krenzer | 28/271 |
| 5,142,754 A | * | 9/1992 | Krenzer | 28/271 |
| 5,287,606 A | | 2/1994 | Ruef | |
| 5,404,706 A | | 4/1995 | Ueno et al. | |
| 5,709,910 A | | 1/1998 | Argyle et al. | |
| 6,032,335 A | * | 3/2000 | Harzenmoser et al. | 19/157 |

FOREIGN PATENT DOCUMENTS

| | | |
|---|---|---|
| DE | 24 30 741 | 1/1975 |
| FR | 2 246 678 | 5/1975 |
| WO | WO 97/30200 | 8/1997 |
| WO | WO 97/38306 | 10/1997 |

* cited by examiner

*Primary Examiner*—Amy B. Vanatta
(74) *Attorney, Agent, or Firm*—Wallenstein & Wagner, Ltd.

(57) ABSTRACT

A method and an apparatus are disclosed for texturing a yarn product. The method includes the step of passing the yarn product along a yarn path through a liquid jet arrangement. The method also includes the step of applying a force to the yarn transversely to the axis thereof.

19 Claims, 2 Drawing Sheets

APPARATUS AND METHOD FOR TEXTURING YARN

RELATED APPLICATIONS

This application is a continuation-in-part of U.S. patent application Ser. No. 09/356,687, filed Jul. 20, 1999, now U.S. Pat. No. 6,139,588, which is a continuation of U.S. patent application Ser. No. 08/737,653, filed Nov. 22, 1996, now U.S. Pat. No. 5,931,972, which claims priority under 35 U.S.C. §119 and 37 C.F.R. §1.55 of International Application No. PCT/GB95/01170; Great Britain Patent Application Serial No. 9410379.3, filed May 24, 1994; Great Britain Patent Application Serial No. 9915924.6, filed Jul. 8, 1999; Great Britain Patent Application Serial No. 9915923.8, filed Jul. 8, 1999; and Great Britain Patent Application Serial No. 9915922.0, filed Jul. 8, 1999.

This application also is related to a co-pending U.S. patent application entitled "Apparatus and Method for Fabrication of Textiles," U.S. No. 09/513,595, filed on Feb. 25, 2000, having the same common assignee, and incorporated herein by reference.

TECHNICAL FIELD

This invention relates to the texturing of textile yarn products, in particular the jet texturing of filament and/or staple yarns, which includes the intermingling of multifilament yarns, the co-mingling of two or more filament yarns and the combining of filament and staple yarns.

BACKGROUND OF THE INVENTION

It is known to perform texturing on one or more textile yarns by passing the yarn or yarns through a jet device in which a jet or jets of air are directed transversely of the traveling yarn or yarns to agitate the filaments or the fibers of the yarns. When intermittent, nips are produced in the yarn or yarns at spaced intervals. Since such jets rely on air turbulence, the degree of texturing or of nip spacing along the yarn is, in consequence, random. While the average degree of texturing or nip production per unit length of yarn processed by such known jets may be satisfactory for certain textile applications, there are often long lengths of yarn produced having no texture or nips. These lengths of yam, when used in knitted or woven fabrics, manifest themselves as unsatisfactory regions in the fabric. In addition, typically a machine for performing such processes can have many, for example 200 or more, processing positions, i.e., 200 or more yarns are processed simultaneously in parallel threadlines. The provision of high pressure air to such numbers of jets is expensive and such a machine is very noisy.

SUMMARY OF THE INVENTION

The present invention provides a method of texturing textile yarn products comprising passing the yam product along a yarn path through a liquid jet arrangement and applying a force to the yam transversely to the axis thereof The invention also provides a process for producing textured yarn products, in which the yarn product is textured by the above method and is cooled. The yarn can be cooled by the liquid jet arrangement. The yam product can be heated prior to being cooled and textured, and can then be wound up. The yarn product can be drawn prior to being cooled and textured.

The method can also comprise applying a forwarding force or a retarding force to the yarn product. The method can comprise applying at least one jet of liquid to the surface of the yarn product transversely to the axis thereof. The method can comprise applying at least one jet of liquid with components of velocity both axially of and transversely to the yarn path through the jet arrangement. The method can comprise applying a plurality of jets of liquid disposed about the axis of the yarn path through the jet arrangement. Preferably, the liquid is water and can be cold water. The supply of water can be pulsed.

The yarn product can also be cooled in a liquid immersion cooling zone, in which case, a cooling liquid can be moved in contraflow to the yarn product passing through the cooling zone. The cooling zone and the liquid jet arrangement can be contiguous. The coolant liquid can be the liquid of the jet arrangement.

The yarn product can be continuous filaments and the process can comprise drawing the yarn product to form a partially oriented yarn. Alternatively, the yarn product can be a plurality of yarns which are combined to form a single coherent yarn. One of the yarns can be a staple yarn.

The process can be controlled by a feedback arrangement. In this case, a property of the yarn product can be measured and the measurement used to control the process. The measurement can be used to control the liquid jet arrangement or a yarn product speed.

The invention can also comprise an apparatus for texturing a yarn product comprising a liquid jet arrangement adapted to apply, to a yarn product traveling along a yarn path through the jet arrangement, a force transversely to the axis of the yarn product.

The apparatus can comprise cooling apparatus. The cooling apparatus can comprise the liquid jet arrangement. The apparatus can also comprise heating apparatus which can be disposed upstream of the cooling apparatus. The apparatus can comprise winding apparatus disposed downstream of the liquid jet arrangement. The apparatus can also comprise drawing means, which can be disposed upstream of the cooling apparatus.

The liquid jet arrangement can be adapted to apply a forwarding force or a retarding force to the traveling yam product. The jet arrangement can apply at least one jet of liquid to the surface of the yarn product transversely to the axis thereof The at least one jet of liquid can be directed to have velocity components both axially of and transversely to the yarn path through the jet arrangement. A plurality of jets can be disposed about the yarn path through the liquid jet arrangement. The liquid jet arrangement can comprise a housing which terminates in a yarn constricting outlet, having an axis defining a yarn path therethrough, with liquid flow channels aimed towards the outlet and transverse to the axis. The housing can comprise at least one seal against liquid escape along the yam path. The seal can be a labyrinth seal, which can be pressurized, and can be gas pressurized, e.g., by compressed air. Preferably, the liquid jet arrangement comprises a water jet arrangement.

The jet arrangement can be arranged in a filament spinning apparatus. Alternatively, the jet arrangement can be arranged in the path of a plurality of yams. The jet arrangement can be disposed downstream of a further cooling arrangement. The further cooling arrangement can be a fluid cooling arrangement in which the yam product passes through a fluid to be cooled by heat transfer thereto. The further cooling arrangement can comprise a cooling chamber having a fluid inlet and a fluid outlet for cooling fluid to be passed therethrough, and a yarn product inlet and yarn product outlet. The cooling fluid can be passed in contraflow relative to the yam product. The cooling chamber can comprise seals against escape of cooling fluid at the yam product inlet and the yarn product outlet. The seals can be labyrinth seals, which can be pressurized, and can be gas pressurized, for example, by compressed air. The cooling fluid can be a liquid and can be water. The flow of liquid through the cooling chamber can be arranged to be turbulent. The jet arrangement and the further cooling arrangement can have a common liquid.

The apparatus can comprise a feedback arrangement operable to control the processing of the yarn product. The feedback arrangement can comprise a measuring instrument operable to measure a property of the yam product, and control means operable in response to a signal from the measuring instrument proportional to the measurement to control the processing of the yarn product. The control means can be operable to control the liquid jet arrangement and/or a yam product speed.

Other features and advantages of the invention will be apparent from the following specification taken in conjunction with the following drawings.

BRIEF DESCRIPTION OF THE DRAWINGS

The invention will now be described with reference to the accompanying drawings in which.

DETAILED DESCRIPTION OF THE PREFERRED EMBODIMENT

Figure 1:
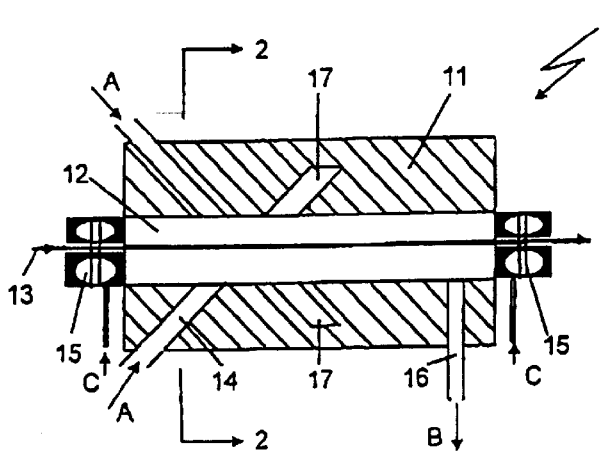
FIG. 1 is a section on the line 1—1 of FIG. 2 of a liquid jet arrangement.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

Figure 2:
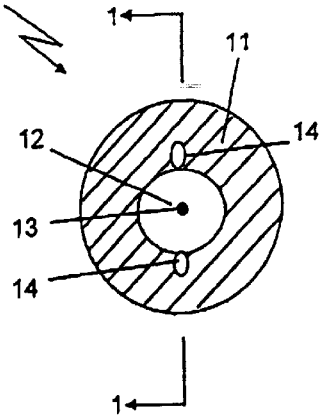
FIG. 2. Is a section on the line 2—2 of FIG. 1 of the liquid jet arrangement.

Referring now to FIGS. 1 and 2, there is shown a liquid jet arrangement 10 in the form of a cylindrical housing 11 having a texturing chamber 12 defining an axial path for the yarn product 13 to pass through the jet 10. Opening into the texturing chamber 12 are inlets 14, two being shown in this case disposed around the yarn 13, for water or other suitable liquid provided from a source (not shown) in the direction of arrows A. Aligned with each inlet 14 on the opposite side of the texturing chamber 12 is a resonance chamber 17. The openings of the inlets 14 are transverse to the axis of the texturing chamber 12 so that the impinging jets of water are transverse to the running yarn product 13 and subject the yarn product 13 to an agitating force. The inlets 14 are directed at an angle to the direction of running of the yarn product 13 so that the water jets have components of velocity axially of the yam product 13 as well as transversely thereof This applies a forwarding force to the yarn product 13 as well as a transverse force. Alternatively, the inlets 14 could be inclined in the reverse direction to apply a retarding force to the yarn product 13. The supply of water to the inlets 14 can be pulsed to produce a more even form of texturing or other desired effect. At each end of the housing 11 is an annular labyrinth seal 15 to prevent escape of water from the texturing chamber 12 along the path of the yarn product 13, the water exiting from the texturing chamber 12 through an outlet 16 in the direction of arrow B. The seals 15 can be pressurized by gas, e.g., compressed air, from a source (not known) in the direction of arrows C.

Figure 3:
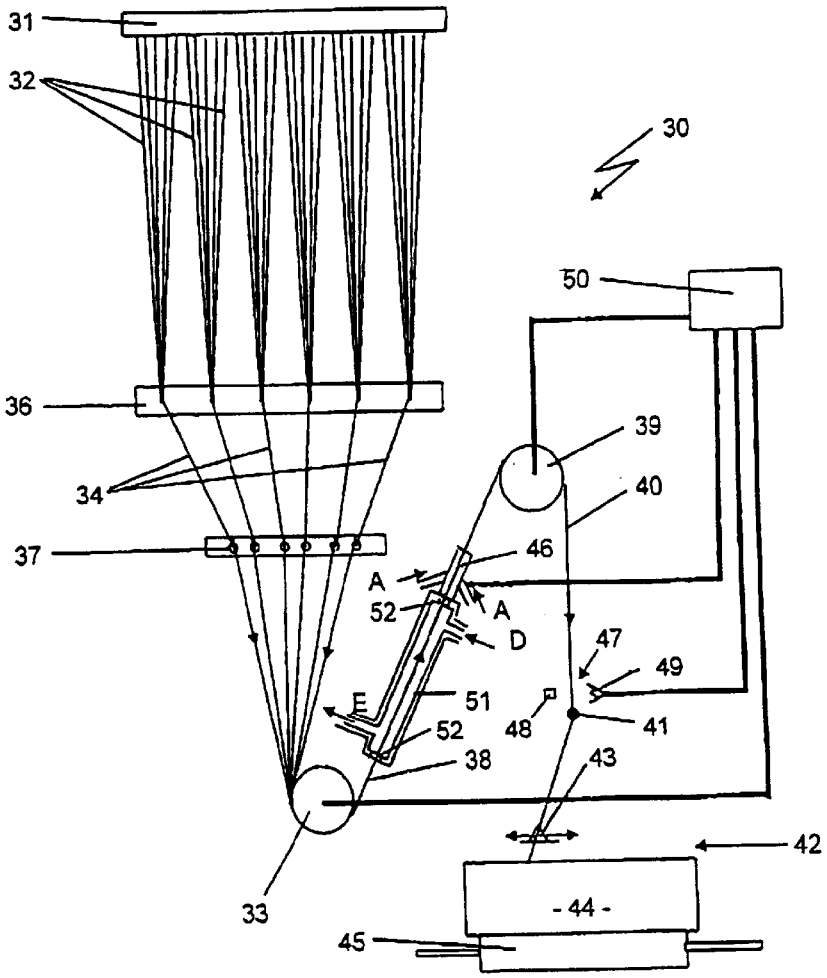
FIGS. 3 and 4 are threadline diagrams of alternative filament spinning apparatus incorporating the liquid jet arrangement of FIGS. 1 and 2; and, FIG. 5 is a yarn co-mingling machine incorporating the liquid jet arrangement of FIGS. 1 and 2.

Referring now to FIG. 3, there is shown a filament spinning apparatus 30 having a spinning head 31 from which filaments 32 are extruded. The filaments 32 are withdrawn from the spinning head 31 by a first feed roller 33. Spin finish oil is applied to the filaments 32 by an oil applicator 36, at which the filaments 32 are brought together to form yarns 34, and the regularity of the oil application is improved by oil dispersion jets 37. The yarns 34 are drawn between the spinning head 31 and the first feed roller 33, and the resulting partially oriented yarn 38 is forwarded to a second feed roller 39. A liquid intermingling jet 46, which directs a jet of liquid at the yarn 38 to intermingle the filaments of the yarn 38, is disposed in the controlled tension zone between the first and second feed rollers 33, 39, but can be placed before the roller 33. The interlaced yarn 40 is passed through an optical interlace sensor 47 to a forwarding point 41. The interlaced partially drawn yarn 40 is then fed from the forwarding point 41 to a take up zone 42 to be wound using a traverse guide 43 onto a package 44 driven by surface contact with a driving bowl 45. The traverse guide 43 reciprocates as shown along a path parallel with the axis of the package 44. The interlace sensor 47 comprises an optical transmitter 48 and an optical receiver 49, a beam from the transmitter 48 being directed at the yarn 40 and then being received by the receiver 49. The receiver 49 sends to a control device 50 a signal which varies in response to the changes in dimension of the intermingled yarn 40, i.e., as interlace nodes pass the sensor 48. The control device 50 is operable to control the supply and/or pressure of liquid to the intermingling jet 46 and/or the speed of the feed rollers 33, 39, and that supply can be pulsed if desired.

Figure 4:
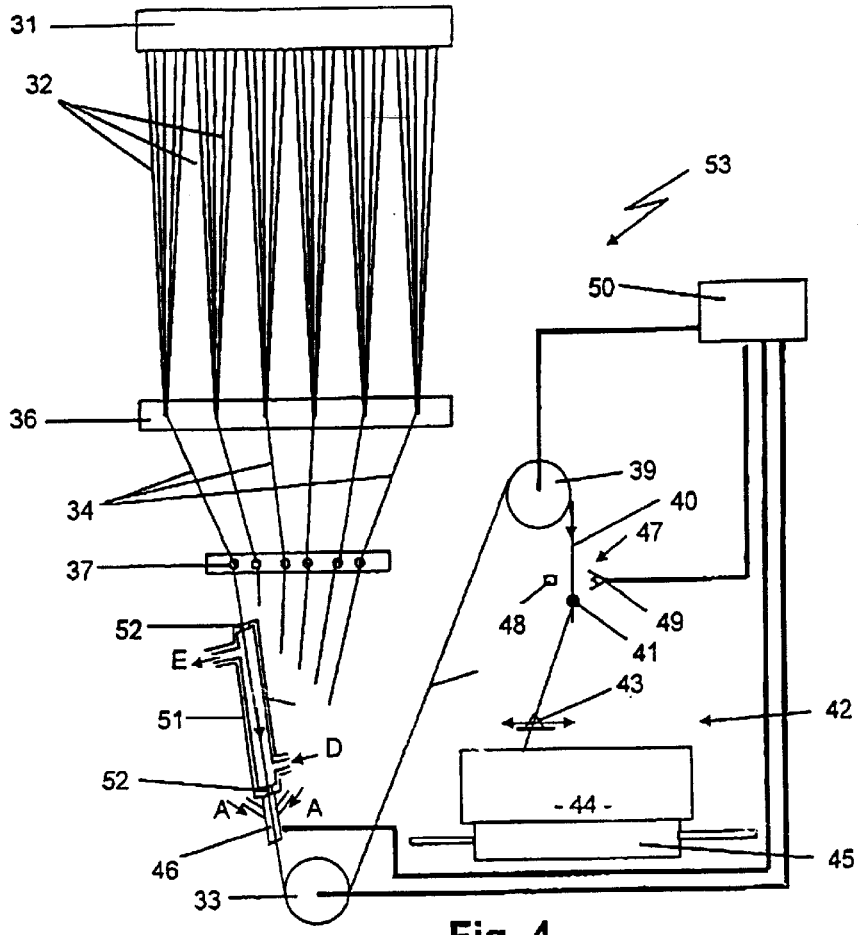

In the case of this invention, the intermingling jet 46 is constructed and operates as the device 10 of FIGS. 1 and 2, with water being introduced into the intermingling jet 46 in the direction of arrows A as described above. Conventionally, the distance between the spinning head 31 and the first feed roller 33, the cooling chimney, is relatively long so that the yarns 34 have cooled to a temperature at which they can be subjected to the intermingling step in the jet 46. However, since the water supplied to the jet 46 is cold, thereby cooling the drawn yarn 38, this can provide sufficient cooling for a significant reduction in the height of the cooling chimney while allowing the satisfactory intermingling of the filaments of the yarn 38 by the jet 46. Alternatively, a further cooling device 51 can be placed in the threadline between the feed roller 33 and the intermingling jet 46. The cooling device 51 is a cylinder through which the yarn 38 passes and into which cooling water is introduced in the direction of arrow D and from which the water exits in the direction of arrow E. With this arrangement, the cooling water passes along the cooling device 51 in turbulent contraflow to the running yarn 38, both of which factors enhance the heat transfer from the yarn 38 to the cooling water. At the opposed ends of the cooling device 51, the yarn inlet and yarn outlet are provided with labyrinth seals 52 which can be pressurized against escape of water therethrough as described in respect of seals 15 of the texturing jet 10. The intermingling jet 46 and the cooling device 51 are shown as contiguous, and the cooling water can pass directly from one to the other. As a further alternative, and provided that the tension in the yarns 34 is not too great, the cooling device 51 and intermingling jet 46 can be disposed between the oil dispersion jets 37 and the first feed roller 33 to further reduce the height of the cooling chimney, as shown in machine 53 in FIG. 4. Only one of the yarns 34 is shown passing through the respective cooling device 51 and intermingling jet 46 for clarity.

Figure 5:
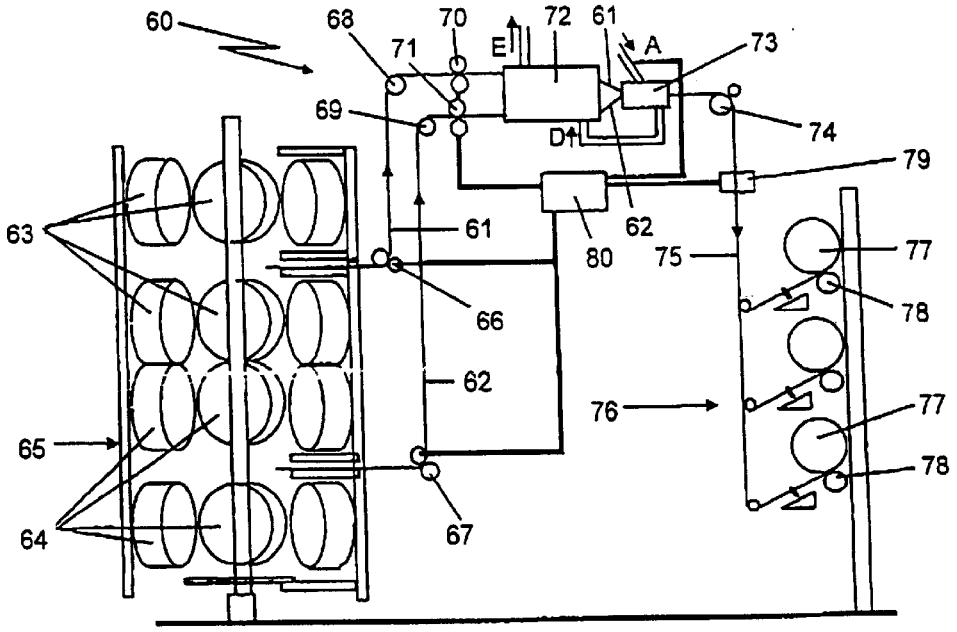

A machine 60 for co-mingling two or more yarns is shown in FIG. 5, in this case two textile yarns 61, 62. The yarns 61, 62, which can be the same as, but are more usually different from, each other, for example one can be a staple yarn, are supplied on respective supply packages 63, 64 mounted in a creel 65. The yarns 61, 62 are withdrawn from the packages 63, 64 by first feed roller pairs 66, 67 and fed along parallel tracks to respective heated rollers or draw pins 68, 69 to respective draw rollers 70, 71 and to a cooling device 72. From the cooling device 72 the yarns 61, 62 pass through a co-mingling device 73 to a second feed roller pair 74. The peripheral speed of the draw rollers 70, 71 is greater than that of the first feed rollers 66, 67 so that the yarns 61, 62 are drawn at the draw rollers or pins 68, 69, and the peripheral speed of the second feed rollers 74 is controlled relative to that of the draw rollers 70, 71 so that the tension in the yarns 61, 62 is controlled for satisfactory co-mingling of the yarns 61, 62, The yarns 61, 62 can be drawn to differing amounts, or one of the yams can be forwarded directly from the feed rollers 66, 67 to the co-mingling device 73 so as not to be heated, drawn and cooled, as required in any particular application. Also, either or both of the yarns 61, 62 can be false twisted, for example one S-twist and one Z-twist, between the feed rollers 66, 67 and the co-mingling device 73. The co-mingling device 73 agitates the yarns 61, 62 to co-mingle their filaments together to form a single coherent yarn 75. The heated rollers 68, 69 heat the yarns 61, 62 to facilitate the drawing step and any false twisting step. The thus co-mingled yarn 75 is forwarded to a take up arrangement 76 in which it is wound onto a bobbin 77 driven by surface contact with a driving bowl 78.

In this machine arrangement, the cooling device 72 and the co-mingling device 73 are shown to be contiguous. In addition, the water introduced into the co-mingling device 73 is forwarded therefrom to the cooling device 72 in the direction of arrow D, so that both devices 73, 72 use the same water. Also, in the case of machine 60, there is shown a measuring instrument 79 which measures a property of the co-mingled yarn 75. Such parameter can be node frequency or coherence. The measuring instrument 79 sends a signal proportional to the value of the measured parameter to a controller 80 which compares that value with a predetermined desired value. If there is a discrepancy between the two values, the controller 80 is operable to control the rate or pressure of water flow to the co-mingling device 73 and/or the speed of the first feed rollers 66, 67, the draw rollers 70, 71 and the second feed rollers 74.

While the specific embodiment has been illustrated and described, numerous modifications come to mind without significantly departing from the spirit of the invention, and the scope of protection is only limited by the scope of the accompanying Claims.

What is claimed is:

1. A method of texturing a yarn product comprising the steps of:

passing the yarn product along a yarn path through a liquid jet arrangement which applies a force to the yarn transversely to the axis thereof, texturing the yarn product and cooling the yarn product, wherein the yarn product is cooled by the liquid jet arrangement; and immersing the yarn product in a liquid immersion cooling zone.

2. The method of claim 1 further including the step of moving a cooling liquid in contraflow to the yarn product passing through the cooling zone.

3. The method of claim 1 wherein the cooling zone and the liquid jet arrangement are contiguous.

4. The method of claim 1 wherein the coolant liquid is the liquid of the jet arrangement.

5. The method of claim 1 wherein the yarn product is continuous filaments and including the step of drawing the yarn product.

6. The method of claim 1 wherein the yarn product is a plurality of yarns and including the step of co-mingling the plurality of yarns to form a coherent yarn.

7. The method of claim 6 wherein one of the plurality of yarns is a staple yarn.

8. The method of 1 further comprising the step of controlling the texturing of the yarn with a feedback arrangement.

9. The method of claim 8 further comprising the step of measuring a property of the yarn product and controlling the texturing of the yarn in response to the measured property.

10. The method of claim 9 further comprising the step of controlling the liquid jet arrangement in response to the measured property.

11. The method of claim 9 further comprising the step of controlling a yarn product speed in response to the measured property.

12. An apparatus for texturing a yarn product comprising:

a liquid jet arrangement adapted to apply to the yarn product traveling along a yarn path through the jet arrangement a force transversely to the axis of the yarn product, wherein the jet arrangement is in a filament spinning apparatus and disposed downstream of a cooling arrangement in which the yarn product passes through a fluid to be cooled by heat transfer thereto, wherein the cooling arrangement includes a cooling chamber with a fluid inlet and a fluid outlet for cooling fluid to be passed therethrough, and the cooling arrangement includes a yarn product inlet and yarn product outlet, and wherein the cooling fluid is passed in contraflow relative to the yarn product.

13. An apparatus for texturing a yarn product comprising:

a liquid jet arrangement adapted to apply to the yarn product traveling along a yarn path through the jet arrangement a force transversely to the axis of the yarn product, wherein the jet arrangement is in a filament spinning apparatus and disposed downstream of a cooling arrangement in which the yarn product passes through a fluid to be cooled by heat transfer thereto, wherein the cooling arrangement includes a cooling chamber with a fluid inlet and a fluid outlet for cooling fluid to be passed therethrough, and the cooling arrangement includes a yarn product inlet and yarn product outlet, and wherein the chamber includes seals against escape of cooling fluid at the yarn product inlet and the yarn product outlet.

14. The apparatus of claim 13 wherein the seals are labyrinth seals.

15. The apparatus of claim 14 wherein the seals are pressurized.

16. The apparatus of claim 15 wherein the seals are gas pressurized.

17. The apparatus of claim 16 wherein the seals are pressurized by compressed air.

18. An apparatus for texturing a yarn product comprising:

a liquid jet arrangement arranged in a filament spinning apparatus and adapted to apply to the yarn product traveling along a yarn path through the jet arrangement a force transversely to the axis of the yarn product, wherein the jet arrangement is disposed downstream of a cooling arrangement, wherein the cooling arrangement includes a cooling chamber for cooling fluid to be passed therethrough, wherein the cooling fluid is a liquid, and wherein the liquid turbulently flows through the chamber.

19. An apparatus for texturing a yarn product comprising: a liquid jet arrangement arranged in a filament spinning apparatus and adapted to apply to the yarn product traveling along a yarn path through the jet arrangement a force transversely to the axis of the yarn product, wherein the jet arrangement is disposed downstream of a fluid cooling arrangement, wherein the cooling fluid is a liquid, and wherein the liquid jet arrangement and the cooling arrangement have a common liquid.

* * * * *

UNITED STATES PATENT AND TRADEMARK OFFICE

CERTIFICATE OF CORRECTION

PATENT NO. : 6,397,444 B1
DATED : June 4, 2002
INVENTOR(S) : Peter William Foster et al.

It is certified that error appears in the above-identified patent and that said Letters Patent is hereby corrected as shown below:

Column 1,
Lines 43, 55, 57 and 61, delete “yam” and insert therefor -- yarn --
Line 57, after the word “thereof” insert -- . --

Column 2,
Lines 40, 52, 61 and 67, delete “yam” and insert therefor -- yarn --
Line 43, after the word “thereof” insert -- . --
Line 58, delete “yams” and insert therefor -- yarns --

Column 3,
Lines 1, 12, 17 and 61, delete “yam” and insert -- yarn --
Line 62, after the word “thereof” insert -- . --

Column 5,
Line 24, delete “yams” and insert therefor -- yarns --.

Signed and Sealed this

Twenty-fifth Day of February, 2003

JAMES E. ROGAN
*Director of the United States Patent and Trademark Office*